US007789054B2

(12) United States Patent
Rozario et al.

(10) Patent No.: US 7,789,054 B2
(45) Date of Patent: Sep. 7, 2010

(54) TWIN CAM PHASER FOR DUAL INDEPENDENT CAM PHASING

(75) Inventors: Frederick J. Rozario, Fenton, MI (US); Joseph E. Robbins, Mayville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 387 days.

(21) Appl. No.: 12/045,241

(22) Filed: Mar. 10, 2008

(65) Prior Publication Data

US 2009/0223470 A1 Sep. 10, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2002/0059910 A1 * 5/2002 Methley et al. ..... 123/90.17

* cited by examiner

*Primary Examiner*—Zelalem Eshete
(74) *Attorney, Agent, or Firm*—Harness, Dickey & Pierce, P.LC.

(57) ABSTRACT

An engine assembly may include a cam phaser assembly coupled to a concentric camshaft. The cam phaser assembly may include first and second plate assemblies that have first and second vanes, an oil chamber housing located axially between the first and second plate assemblies, an oil distribution member, and a first fastener. The first and second plates may define first and second fastener passages. The oil chamber housing may define first and second chambers and a first central bore. The first vane may extend into the first chamber and the second vane may extend into the second chamber. The oil distribution member may be located within the central bore of the oil chamber housing and may define a third fastener passage. The first fastener may extend through the first, second, and third fastener passages and couple the cam phaser assembly to an outer shaft of the concentric camshaft.

20 Claims, 6 Drawing Sheets

TWIN CAM PHASER FOR DUAL INDEPENDENT CAM PHASING

FIELD

The present disclosure relates to cam phasers, and more specifically to dual independent cam phasers.

BACKGROUND

The statements in this section merely provide background information related to the present disclosure and may not constitute prior art.

Engine assemblies may include a cam phaser that is coupled to an engine camshaft to adjust timing of intake and/or exhaust valve opening events. Adjusting valve timing based on engine operating conditions may provide increased engine performance, such as increased power output, reduced fuel consumption, and/or reduced engine emissions. Increasing the extent that the camshaft may be advanced or retarded may provide for increased performance gains.

SUMMARY

An engine assembly may include an engine structure, a concentric camshaft rotatably supported on the engine structure, and a cam phaser assembly coupled to the concentric camshaft. The concentric camshaft may include an outer shaft, an inner shaft, and first and second lobe members. The first lobe member may be fixed for rotation with the outer shaft. The second shaft may be rotatably disposed within the first shaft and the second lobe member may be fixed for rotation with the second shaft. The cam phaser assembly may be coupled to the concentric camshaft and may include first and second plate assemblies, an oil chamber housing located axially between the first and second plates, an oil distribution member, and a first fastener. The first plate assembly may include a first vane fixed to and extending axially from a first plate. The second plate assembly may include a second vane fixed to and extending axially from a second plate. The first and second plates may define first and second fastener passages. The oil chamber housing may be located axially between the first and second plates and may define first and second chambers and a first central bore. The first vane may extend into the first chamber and the second vane may extend into the second chamber. The oil distribution member may be located within the first central bore of the oil chamber housing and may define a first oil passage in communication with the first chamber, a second oil passage in communication with the second chamber, and a third fastener passage. The first fastener may extend through the first, second, and third fastener passages and couple the cam phaser assembly to the outer shaft of the concentric camshaft.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
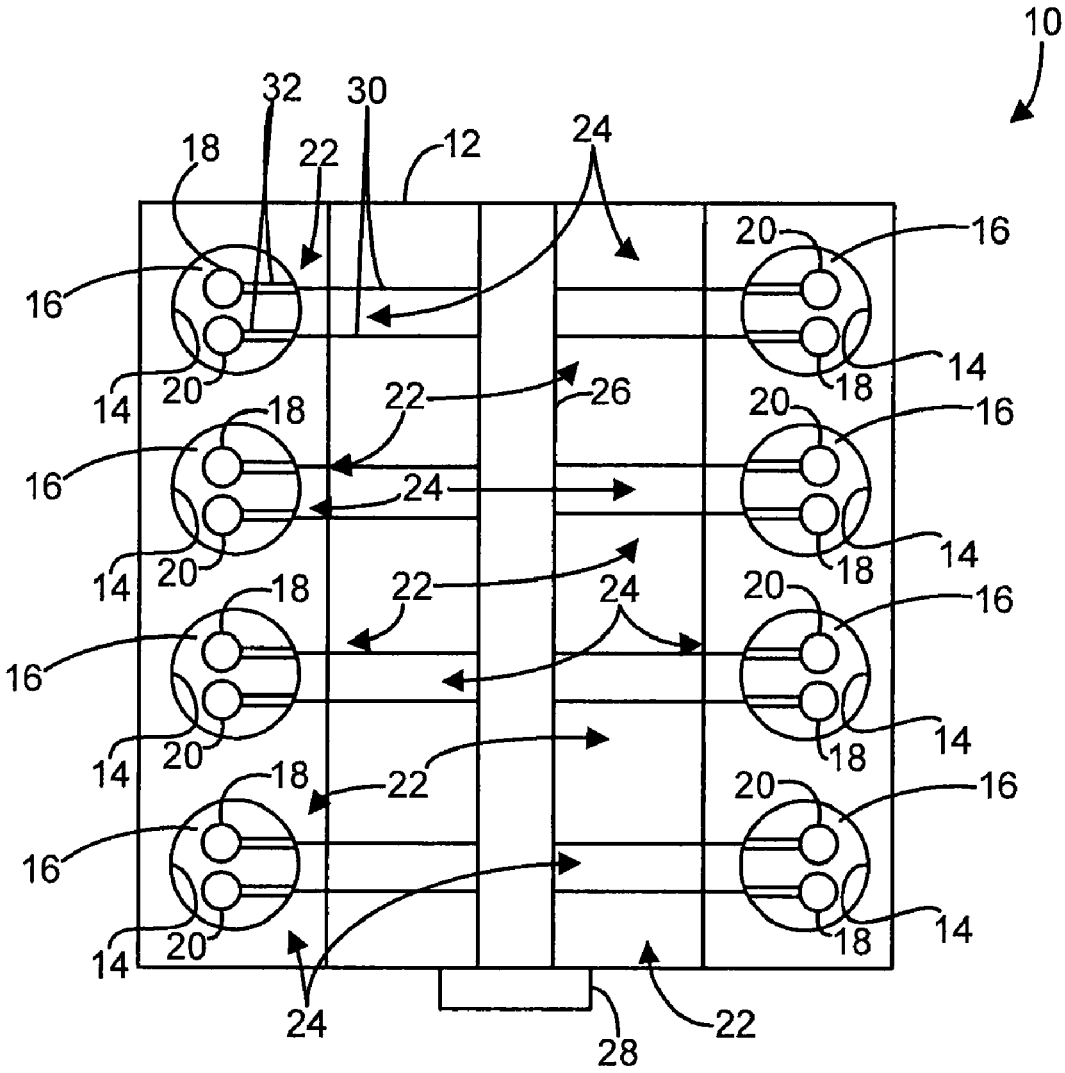
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Figure 2:
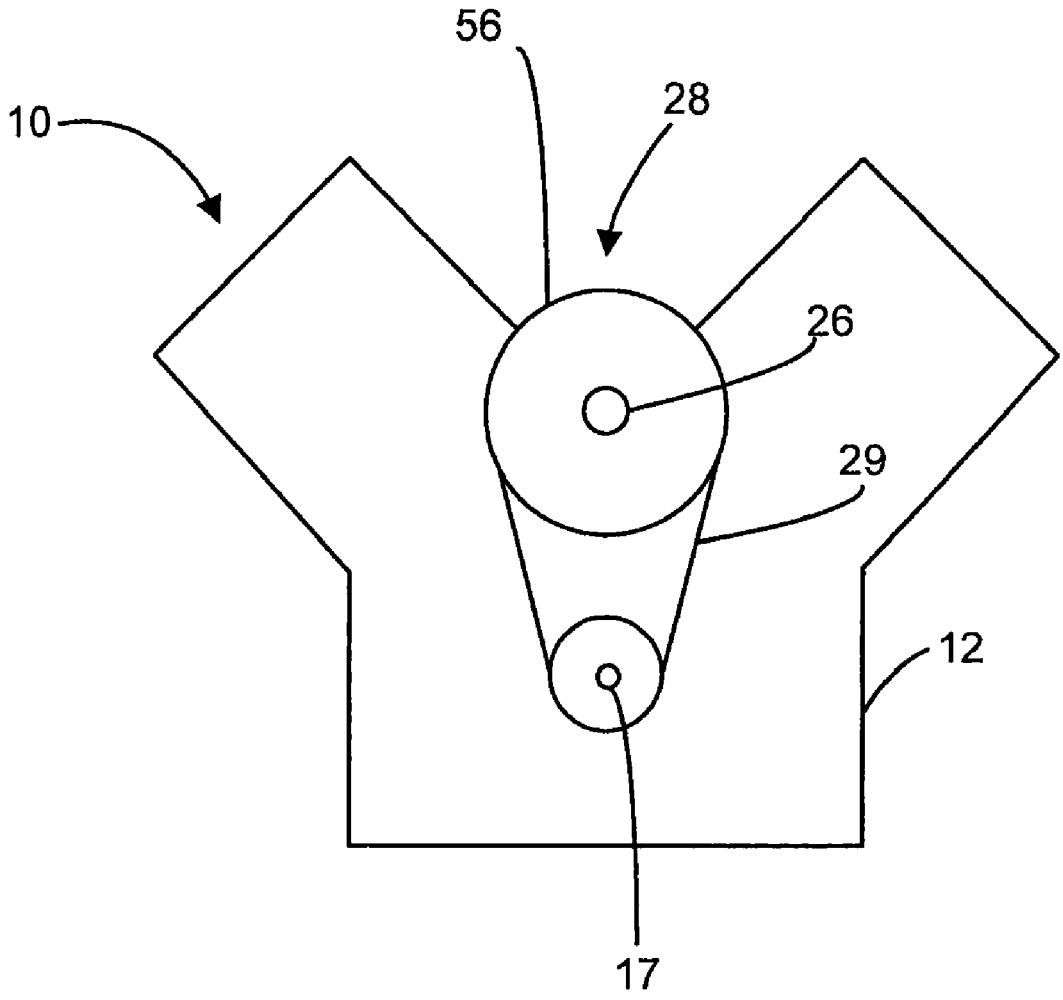
FIG. 2 is an additional schematic illustration of the engine assembly of FIG. 1.

Referring now to FIGS. 1 and 2, an exemplary engine assembly 10 is schematically illustrated. The engine assembly 10 may include an engine 12 including a plurality of cylinders 14 having pistons 16 disposed therein and a crankshaft 17. The crankshaft 17 may be rotatably supported by an engine structure, such as an engine block, and may be rotationally driven by the pistons 16. The engine 12 may further include an intake valve 18, an exhaust valve 20, intake and exhaust valve lift mechanisms 22, 24 for each cylinder 14, as well as a camshaft 26, a cam phaser assembly 28, and a drive belt 29 (such as a chain drive) that rotatably couples the crankshaft 17 to the cam phaser assembly 28.

The intake valve lift mechanisms 22 may each include a pushrod 30 and a rocker arm 32. The exhaust valve lift mechanisms 24 may each include a pushrod 30 and a rocker arm 32 as well. The camshaft 26 may be supported by an engine structure such as an engine block. The pushrods 30 may be engaged with the camshaft 26 to actuate the rocker arms 32 and open the intake and exhaust valves 18, 20. While the engine assembly 10 is illustrated as a pushrod engine assembly, it is understood that the present disclosure may be applicable to a variety of other engine configurations as well, such as overhead cam engines, where the camshaft 26 is supported by a cylinder head.

Figure 3:
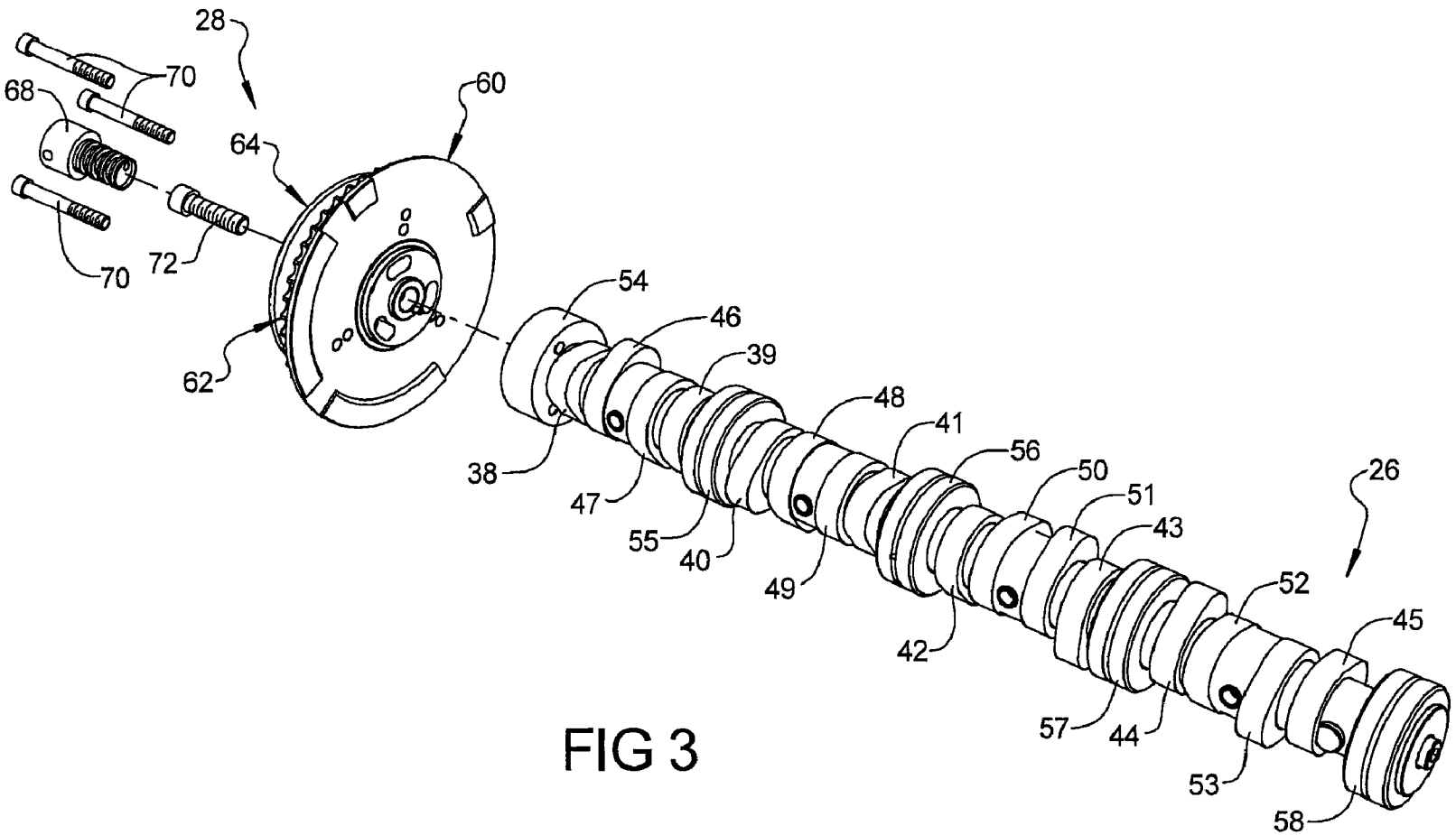
FIG. 3 is a perspective exploded view of a camshaft and cam phaser assembly of the engine assembly of FIG. 1.
Figure 4:
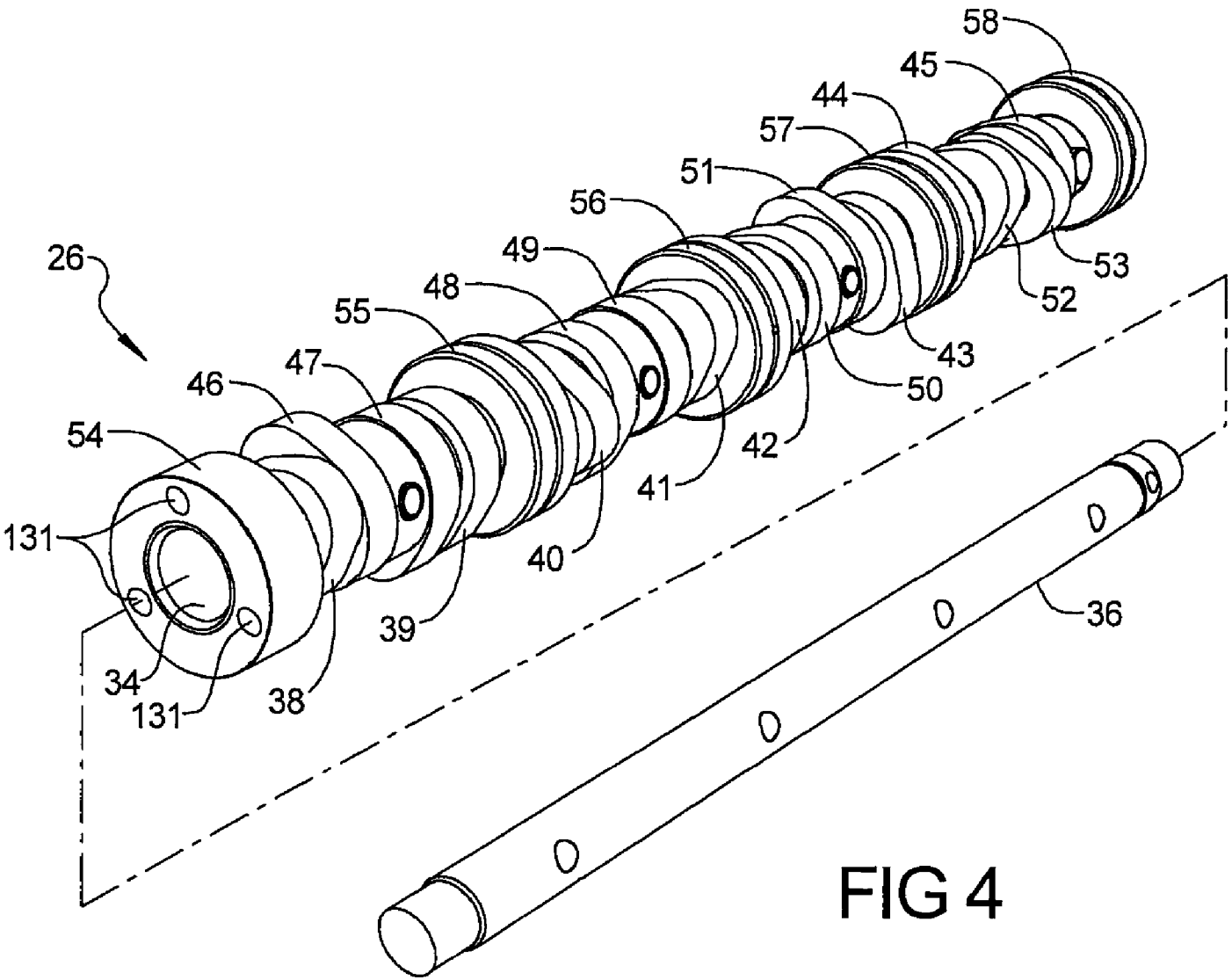
FIG. 4 is an exploded view of the camshaft assembly of FIG. 3.

With reference to FIGS. 3 and 4, the camshaft 26 may form a concentric camshaft assembly and may include first and second shafts 34, 36, a first set of lobe members 38, 39, 40, 41, 42, 43, 44, 45, a second set of lobe members 46, 47, 48, 49, 50, 51, 52, 53, and bearing journals 54, 55, 56, 57, 58. The second shaft 36 may be rotatably disposed within the first shaft 34. The first set of lobe members 38, 39, 40, 41, 42, 43, 44, 45 and the bearing journals 54, 55, 56, 57, 58 may be fixed for rotation with the first shaft 34. The second set of lobe members 46, 47, 48, 49, 50, 51, 52, 53 may be fixed for rotation with the second shaft 36. In the present example, the first set of lobe members 38, 39, 40, 41, 42, 43, 44, 45 may form an intake lobe set and the second set of lobe members 46, 47, 48, 49, 50, 51, 52, 53 may form an exhaust lobe set. However, it is understood that alternate arrangements may be provided where the first set of lobe members 38, 39, 40, 41, 42, 43, 44, 45 may form an exhaust lobe set and the second set of lobe members 46, 47, 48, 49, 50, 51, 52, 53 may form an intake lobe set.

Figure 5:
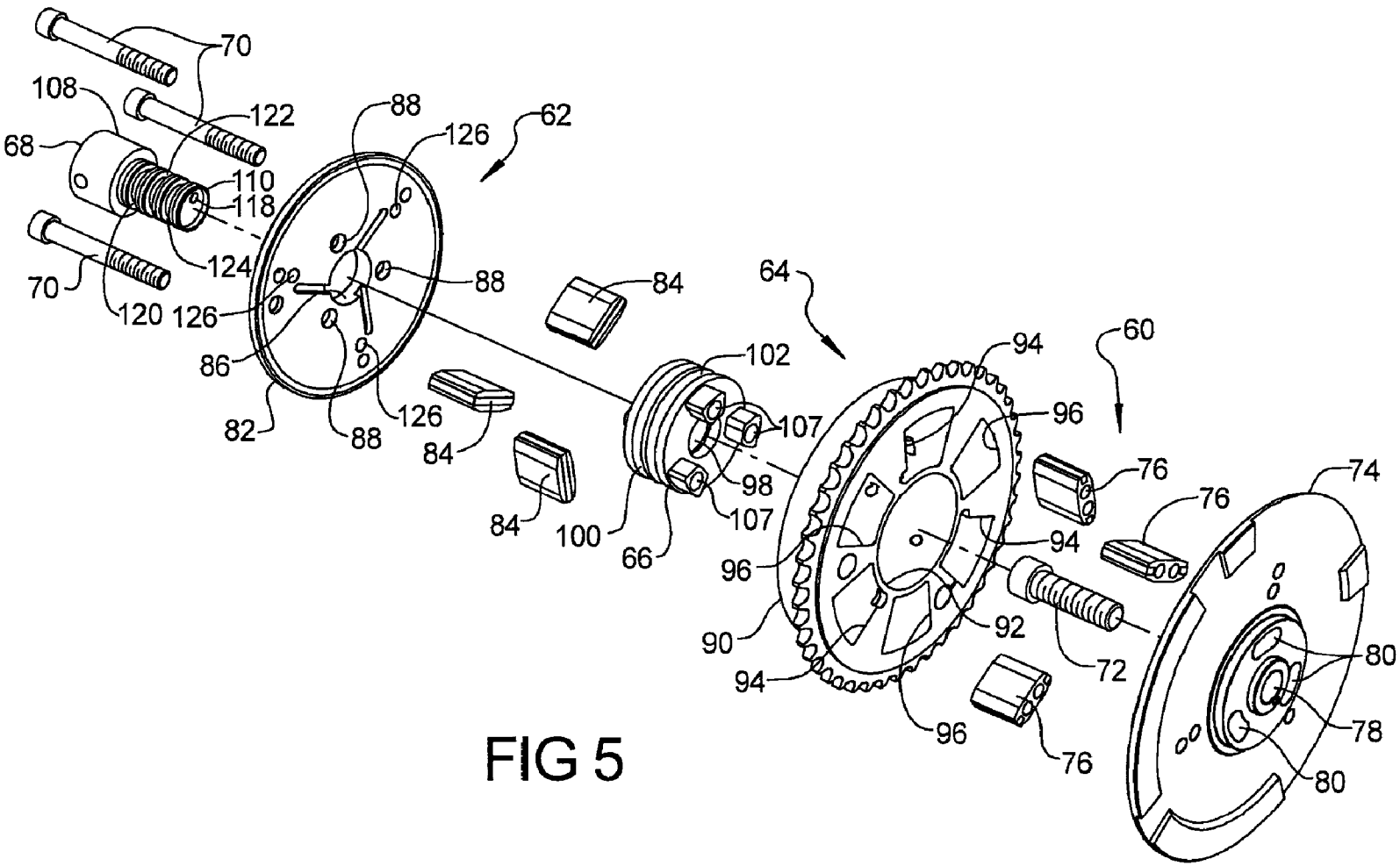
FIG. 5 is an exploded view of the cam phaser assembly of FIG. 3.
Figure 6:
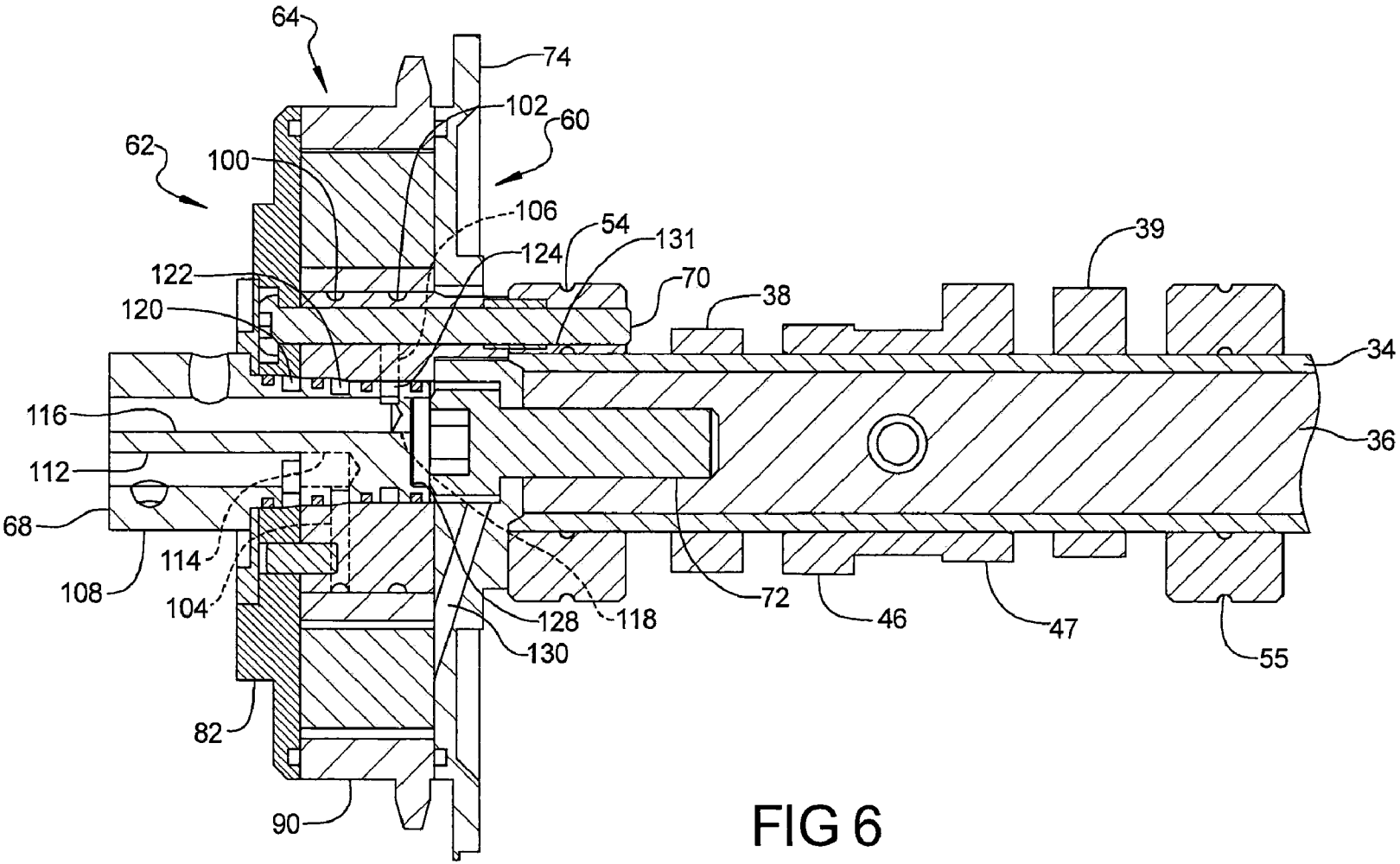
FIG. 6 is a fragmentary section view of the camshaft and cam phaser assembly of FIG. 3.

With reference to FIGS. 3, 5, and 6, the cam phaser assembly 28 may include a first plate assembly 60, a second plate assembly 62, an oil chamber housing 64, an oil distribution member 66, an oil feed member 68, first fasteners 70, and a second fastener 72. The first plate assembly 60 may include a first plate 74 and a first set of vanes 76 fixed to and extending axially from the first plate 74. While the first plate assembly 60 includes three vanes 76 in the present example, it is understood that more or fewer vanes may be used. The first plate 74 may include a central bore 78 and a set of first fastener passages 80 located radially outwardly from the central bore 78. The first fastener passages 80 may each be generally arcuate in shape to allow rotation of the first plate 74 relative to the first fasteners 70, as discussed below.

The second plate assembly 62 may include a second plate 82 and a second set of vanes 84 fixed to and extending axially from the second plate 82. While the second plate assembly 62 includes three vanes 84 in the present example, it is understood that more or fewer vanes may be used. The second plate 82 may include a central bore 86 and a set of second fastener passages 88. The oil chamber housing 64 may be located axially between the first and second plates 74, 82.

The oil chamber housing 64 may include a body 90 that defines a central bore 92 and first and second sets of chambers 94, 96 located radially outwardly from the central bore 92. The first set of vanes 76 may extend into the first set of chambers 94 and the second set of vanes 84 may extend onto the second set of chambers 96. The body 90 may include fluid passages (not shown) that extend from the central bore 92 to the first and second sets of chambers 94, 96.

The oil distribution member 66 may be located within the central bore 92 of the oil chamber housing 64 and may be contained between the first and second plates 74, 82. The oil distribution member 66 may include a central bore 98, first and second annular groves 100, 102, a first radially extending oil passage 104 extending from the central bore 98 to the first annular groove 100, a second radially extending oil passage 106 extending from the central bore 98 to the second annular groove 102, and third fastener passages 107.

The oil feed member 68 may be rotationally fixed relative to an engine structure, such as an engine block and/or an engine front cover. The oil feed member 68 may extend through the central bore 86 of the second plate 82 and into the central bore 98 of the oil distribution member 66. The oil feed member 68 may include first and second portions 108, 110. The first portion 108 may be located outside of the oil chamber housing 64 and may include passages 112, 114, 116, 118 in communication with an oil supply. For example, the passages 112, 114, 116, 118 may be in communication with a phaser oil control valve (not shown). The second portion 110 may include annular grooves 120, 122, 124. The annular groove 120 may be in communication with the passage 112, the annular groove 122 may be in communication with the passage 114, and the annular groove 124 may be in communication with the passage 116.

When assembled, the annular groove 120 may be in communication with oil passages 126 in the second plate 82 that are in communication with the second set of chambers 96 in the oil chamber housing 64. The annular groove 122 may be in communication with the first radially extending oil passage 104 and the annular groove 124 may be in communication with the second radially extending oil passage 106. The passage 118 in the oil feed member 68 may be in communication with a chamber 128 created between an end of the oil feed member 68 and a portion of the first plate 74. The chamber 128 may be in communication with oil passages 130 in the first plate 74 that are in communication with the first set of chambers 94 in the oil chamber housing 64.

The first fasteners 70 may include bolts and may extend through the first, second, and third fastener passages 80, 88,107 and into apertures 131 in the bearing journal 54 to rotationally couple the cam phaser assembly 28 to the bearing journal 54, and therefore to the camshaft 26. The first fasteners 70 may have a threaded engagement with the apertures 131. The second fastener 72 may include a bolt and may extend through the first plate 74 and into the second shaft 36 to fix the second shaft 36 for rotation with the first plate assembly 60. The central bore 86 in the oil feed member 68 may provide access to the second fastener 72.

The first and second plate assemblies 60, 62, the oil chamber housing 64, and the oil distribution member 66 may be rotatable on the oil feed member 68. The oil chamber housing 64 may include a hub 132 having a series of teeth 134 engaged with the drive belt 29 shown in FIG. 2, and therefore may be driven by the crankshaft 17. The rotation of the oil chamber housing 64 may be transferred to the first and second plate assemblies 60, 62 by pressurized fluid within the first and second sets of chambers 94, 96 acting on the first and second sets of vanes 76, 84.

The engagement between the first fasteners 70 and the second plate 82 may cause the first shaft 34 to rotate with the second plate assembly 62. The first fasteners 70 may also transfer the weight of the cam phaser assembly 28 to the bearing journal 54 which may rotatably support the cam phaser assembly 28 on the engine structure. The engagement between the second fastener 72, the first plate 74, and the second shaft 36 may cause the second shaft 36 to rotate with the first plate assembly 60. The first and second plate assemblies 60, 62 may rotate relative to one another and relative to the oil chamber housing 64. The arcuate shape of the first fastener passages 80 may allow for rotation of the first fasteners 70 within the first fastener passages 80, and therefore relative to the first plate assembly 60.

What is claimed is:

1. A cam phaser assembly comprising:

a first plate assembly including a first vane fixed to and extending axially from a first plate, the first plate defining a first fastener passage;

a second plate assembly including a second vane fixed to and extending axially from a second plate, the second plate defining a second fastener passage;

an oil chamber housing located axially between the first and second plates and defining first and second chambers, and a first central bore, the first vane extending into the first chamber and the second vane extending into the second chamber;

an oil distribution member located within the first central bore of the oil chamber housing and defining a first oil passage in communication with the first chamber, a second oil passage in communication with the second chamber, and a third fastener passage; and a first fastener extending through the first, second, and third fastener passages that couples the cam phaser assembly to an outer shaft of a concentric camshaft.

2. The cam phaser assembly of claim 1, wherein the first fastener passage includes an arcuate shape to provide for rotation of the first plate assembly relative to the first fastener.

3. The cam phaser assembly of claim 2, wherein the second plate assembly is fixed for rotation with the first fastener.

4. The cam phaser assembly of claim 3, wherein the oil distribution member is fixed for rotation with the first fastener.

5. The cam phaser assembly of claim 4, wherein the oil chamber housing is rotatable relative to the oil distribution member.

6. The cam phaser assembly of claim 3, further comprising a second fastener extending through the first plate to fix the first plate assembly to an inner shaft of the concentric camshaft.

7. The cam phaser assembly of claim 6, wherein the oil distribution member includes a second central bore providing access to the second fastener.

8. The cam phaser assembly of claim 1, further comprising an oil feed member, the oil distribution member including a second central bore and the oil feed member being located in the second central bore to provide an oil supply to the first and second oil passages of the oil distribution member.

9. The cam phaser assembly of claim 8, wherein the first plate assembly, the second plate assembly, the oil chamber housing, and the oil distribution member are rotatable relative to the oil feed member.

10. The cam phaser assembly of claim 1, wherein the oil chamber housing includes a drive hub adapted to be rotationally driven by a belt.

11. An engine assembly comprising:

an engine structure;

a concentric camshaft rotatably supported on the engine structure and including an outer shaft, an inner shaft, and first and second lobe members, the first lobe member fixed for rotation with the outer shaft, the inner shaft rotatably disposed within the outer shaft, and the second lobe member fixed for rotation with the inner shaft; and a cam phaser assembly coupled to the concentric camshaft and including:

a first plate assembly including a first vane fixed to and extending axially from a first plate, the first plate defining a first fastener passage;

a second plate assembly including a second vane fixed to and extending axially from a second plate, the second plate defining a second fastener passage;

an oil chamber housing located axially between the first and second plates and defining first and second chambers and a first central bore, the first vane extending into the first chamber and the second vane extending into the second chamber;

an oil distribution member located within the first central bore of the oil chamber housing and defining a first oil passage in communication with the first chamber, a second oil passage in communication with the second chamber, and a third fastener passage; and a first fastener extending through the first, second, and third fastener passages that couples the cam phaser assembly to the outer shaft of the concentric camshaft.

12. The engine assembly of claim 11, wherein the concentric camshaft includes a bearing journal rotationally fixed to an end of the outer shaft proximate the cam phaser assembly, the first fastener engaged with the bearing journal and rotatably coupling the first and second plate assemblies and the oil distribution member to the bearing journal.

13. The engine assembly of claim 12, wherein the bearing journal supports the cam phaser assembly on the engine structure.

14. The engine assembly of claim 11, wherein the first fastener passage includes an arcuate shape to provide for rotation of the first plate assembly relative to the first fastener.

15. The engine assembly of claim 14, wherein the second plate assembly is fixed for rotation with the first fastener.

16. The engine assembly of claim 15, wherein the oil distribution member is fixed for rotation with the first fastener.

17. The engine assembly of claim 16, wherein the oil chamber housing is rotatable relative to the oil distribution member.

18. The engine assembly of claim 15, further comprising a second fastener extending through the first plate and engaged with the inner shaft of the concentric camshaft to fix the inner shaft for rotation with the first plate assembly.

19. The engine assembly of claim 11, further comprising an oil feed member rotationally fixed to the engine structure, the oil distribution member including a second central bore and the oil feed member being located within the second central bore to provide an oil supply to the first and second oil passages of the oil distribution member.

20. The engine assembly of claim 11, further comprising a crankshaft rotatably supported by the engine structure, the oil chamber housing including a drive hub rotationally driven by the crankshaft.

* * * * *